US009949018B2

(12) United States Patent
Mikalauskas

(10) Patent No.: US 9,949,018 B2
(45) Date of Patent: Apr. 17, 2018

(54) DISTRIBUTED MODE LOUSPEAKER DAMPING OSCILLATIONS WITHIN EXCITER FEET

(71) Applicant: Amina Technologies Limited, Huntingdon, Cambridgeshire (GB)

(72) Inventor: Egidijus Mikalauskas, Cambridgeshire (GB)

(73) Assignee: AMINA TECHNOLOGIES LIMITED (GB)

( * ) Notice: Subject to any disclaimer, the term of this patent is extended or adjusted under 35 U.S.C. 154(b) by 0 days.

(21) Appl. No.: 15/173,410

(22) Filed: Jun. 3, 2016

(65) Prior Publication Data

US 2016/0360313 A1 Dec. 8, 2016

(51) Int. Cl.

| | |
|---|---|
| ***H04R 1/20*** | (2006.01) |
| ***H04R 1/28*** | (2006.01) |
| ***H04R 7/04*** | (2006.01) |
| ***H04R 9/06*** | (2006.01) |
| *H04R 7/24* | (2006.01) |
| *H04R 7/26* | (2006.01) |

(52) U.S. Cl.

CPC ..... *H04R 1/2896* (2013.01); *H04R 1/2873* (2013.01); *H04R 7/045* (2013.01); *H04R 9/06* (2013.01); *H04R 7/24* (2013.01); *H04R 7/26* (2013.01); *H04R 2440/05* (2013.01)

(58) Field of Classification Search

CPC ..... H04R 9/046; H04R 9/066; H04R 9/025; H04R 1/2896; H04R 1/2873; H04R 7/045; H04R 9/06; H04R 7/24; H04R 2440/05

USPC ..... 381/354

See application file for complete search history.

(56) References Cited

U.S. PATENT DOCUMENTS 6,618,487 B1 * 9/2003 Azima ..... H04R 1/24 381/152

2001/0026625 A1 * 10/2001 Azima ..... H04R 7/045 381/152

* cited by examiner

*Primary Examiner* — Sunita Joshi

(74) *Attorney, Agent, or Firm* — Workman Nydegger

(57) ABSTRACT

There is provided a flat panel loudspeaker comprising a resonant panel, an exciter comprising a foot generally cylindrical in shape, coupled to the resonant panel and defining an inner region of the resonant panel. The exciter is drivable to vibrate the resonant panel via the foot, whereby to produce a sound. A stiffness of the resonant panel in the inner region is greater than a stiffness of the resonant panel in a region of the resonant panel outside the inner region. Additionally or alternatively, the flat panel loudspeaker further comprises a damping member in contact with the inner region of the resonant panel and arranged inside the foot to generally brace against the vibration of the resonant panel so as to damp a response of the resonant panel in the inner region to a vibration from the exciter.

20 Claims, 6 Drawing Sheets

DISTRIBUTED MODE LOUSPEAKER DAMPING OSCILLATIONS WITHIN EXCITER FEET

CROSS-REFERENCE TO RELATED APPLICATIONS

The present invention claims the benefit of priority to Great Britain Patent Application No. 1509715.7 filed Jun. 4, 2015 entitled "Distributed mode loudspeaker damping oscillations within exciter feet" the entire content of which is incorporated herein by reference.

BACKGROUND

The Field of the Invention

This invention relates to a distributed mode loudspeaker, in particular a flat panel loudspeaker. A type of driver referred to as an electro-dynamic "exciter", for example of the type disclosed in international patent application publication number WO98/34320 A2, is one that is used as a transducer in, for example, distributed mode vibrating panel loudspeakers to vibrationally excite a resonant flat panel member thereof in response to the exciter being driven by an electrical audio signal. An example of a distributed mode flat panel loudspeaker is shown in FIG. 1.

The distributed mode vibrating panel loudspeaker 1 has a resonant panel 2, which may be a flat (or curved) panel preferably formed of a lightweight (e.g. honeycomb) composite or monolithic structure, mounted to a support frame 3 to be vibrationally excitable by a carefully positioned electro-dynamic exciter 40 also mounted to the support frame 3 (or alternatively inertially mounted). The resonant panel 2 has a front surface and a back surface. The front surface of the resonant panel faces outwards opposite the support frame 3. The exciter 40 is attached to the back surface of the resonant panel 2. The resonant panel 2 is typically formed from the same material having the same material structure across the whole resonant panel 2. The exciter 40 is driven by an electrical signal received at terminals thereof from, for example, an audio amplifier unit (not shown), via conductive cables 20. When caused to vibrate by exciter 40, the resonant panel 2 acts to amplify these vibrations in a similar manner to a soundboard of a violin or piano such that the distributed mode vibrating panel loudspeaker 1 produces sound from the electrical signal.

FIG. 2 is an illustration of the structure of the exciter 40 in the distributed mode vibrating panel loudspeaker of FIG. 1. By way of explanation, to facilitate understanding of the present invention, a description of the structure of a conventional moving coil drive unit provided as an electrodynamic inertial vibration exciter will now be provided with reference to FIG. 2. The exciter 40 comprises a coil assembly 43, 44 and a magnet assembly 45, 46, 47 adapted to move axially relative to each other. The exciter 40 is adapted to be fixed in any convenient fashion to the resonant panel 2 of a distributed mode vibrating panel loudspeaker 1 (see FIG. 1) to be excited to impart bending wave energy to the resonant panel 2 when an electrical signal is applied thereto. In the illustrated arrangement shown in FIG. 2 the exciter 1 is coupled only to and is supported only by the resonant panel and so the magnet assembly itself 45, 46, 47 forms an inertial mass to cause the coil assembly 43, 44 and resonant panel 2 (in this case a flat panel) to vibrate in use and so produce an amplified sound.

The coil assembly 43, 44 comprises a voice coil 43, e.g. of wire, wound on a tubular coil former 44 which is supported at its lower end 57, as seen in FIG. 2, in an annular groove 58 in an annular coil carrier 49 which forms a foot by which the coil assembly is secured e.g. by means of an adhesive or the like, to a face of the resonant panel 2. Alternatively the coil carrier could be secured to the resonant panel 2 by fixing means, e.g. fasteners. Such fasteners may be releasable. Thus a bayonet connector may be provided, one part of which is fixed to the resonant panel 2 and the other part of which is formed integrally with the exciter 1. The coil former 44 may be secured in the groove 58 by means of an adhesive.

Typically, the coil assembly 43, 44 and magnet assembly 45, 46, 47 are formed separately and then coupled together for later use through a suspension component or assembly. FIG. 2 shows the coil assembly 43, 44 and magnet assembly 45, 46, 47 in the coupled together configuration. The coil assembly 43, 44 is in the exciter shown in FIG. 2 surrounded by an annular coupling resonant member 52 which is connected to the coil assembly carrier 49 by a resilient annular suspension diaphragm 51 e.g. a 'spider' of rubber-like material which is formed with a concentric annular corrugation 59 to facilitate axial movement of the coupling resonant member relative to the carrier. The carrier 49 and the coupling resonant member 52 may be of hard plastics and may be co-moulded together with the resilient diaphragm 11 to form an integrated suspension component or assembly. The interior of the annular carrier 49 is closed by a disc 50 e.g. of foamed plastics, to form a dust seal closing the interior of the exciter. However, this direct coupling, for example through an integrated suspension component or assembly is not essential. For example, the magnet assembly 45, 46, 47 may be suspended by support frame 3 of a distributed mode vibrating panel loudspeaker 1, fixed in place relative to coil assembly 43, 44, which is in turn fixed in place to resonant panel 2. In this case, the magnet assembly 45, 46, 47 and coil assembly 43, 44 may be movable axially relative to each other without being directly coupled. However, a direct coupling may also be provided which helps ensure radial alignment and axial positioning of the magnet assembly 45, 46, 47 and coil assembly 43, 44, which is important to ensure efficiency and power output.

While the geometry and configuration of the magnet assembly can vary widely, in the example exciter illustrated in FIG. 2 the magnet assembly 45, 46, 47 comprises a generally disc-shaped permanent magnet 45 sandwiched between opposed pole pieces 46, 47. The front pole piece 47 is also generally disc-shaped and is co-extensive with the magnet 45. The back pole piece 46 is generally cup-shaped and is formed with a downturned flange 48 surrounding the magnet 45 and pole piece 47 to form an annular magnetic gap 60 in which a high magnetic field is produced and in which the voice coil 43 of the coil assembly is received/suspended in use when the coil assembly 43, 44 and magnet assembly 45, 46, 47 are suspended in position relative to each other.

The free end of the flange 48 is formed as an outwardly extending lip 62 which is formed with an annular recess at its outer end to define a socket into which the coupling resonant member 52 can be snugly received in the manner of a spigot and socket joint firmly to hold the magnet assembly and the coil assembly together. Snap-action clips 53 on the coupling resonant member 52 engage the lip 62 to prevent disengagement.

The coupling resonant member 52 is formed with a pair of terminal flanges carrying electrical terminals (not shown)

which are electrically connected to the voice coil 43 via coil wires or tails, whereby the coil can be connected to a signal source and energised thereby.

The coil assembly carrier 49 (the foot) is generally cylindrically shaped. In this regime, a central region 4 exists on the resonant member 2, which is within a boundary of the foot and in which there is no direct connection between the exciter 40 and the resonant panel 2. If left unaltered, the central region 4 can vibrate significantly when the vibrating panel loudspeaker 1 is excited by the exciter 40 as shown in FIG. 3. FIG. 3 is a Finite Element Analysis (FEA) model of the resonant panel 2, showing an theoretical exaggerated displacement of the central region 4 when the resonant panel 2 is vibrated. The vibrations of the central region can detrimentally interact with those in the region surrounding the central region. This detrimental interaction can result in a frequency response of the whole distributed mode vibrating panel loudspeaker as shown in FIG. 4. FIG. 4 is an illustration of a frequency response calculated using the FEA model of FIG. 3. In particular, region A in FIG. 4 shows a region of "drum skin" resonance where there is a detrimental reduction in the amplitude of the response in the distributed mode flat panel loudspeaker for certain high frequencies. In particular, frequencies around 11 kHz are significantly reduced. In general, the present invention seeks to improve the performance of distributed mode vibrating panel loudspeakers of the prior art.

BRIEF SUMMARY OF THE DISCLOSURE

One solution is to remove the central region from the resonant panel entirely. Whilst this improves the performance of the distributed mode vibrating panel loudspeaker by increasing the amplitude of the frequency response in the affected area, the resulting hole can be unsightly and is typically covered with a fabric cover. In some embodiments of flat panel loudspeakers, it is desirable to hide the loudspeaker in a surface such as a wall by applying a thin covering over the loudspeaker, such as plaster. This is not possible with a hole in the resonant panel. Therefore, another solution is required.

In accordance with an aspect of the present invention there is provided a flat panel loudspeaker comprising a resonant panel, an exciter comprising a foot generally cylindrical in shape, coupled to the resonant panel and defining an inner region of the resonant panel. The exciter is drivable to vibrate the resonant panel via the foot, whereby to produce a sound. The flat panel loudspeaker further comprises a damping member coupled to the foot and in contact with the inner region of the resonant panel and arranged inside the foot to generally brace against the vibration of the resonant panel so as to damp a response of the resonant panel in the inner region to a vibration from the exciter.

Thus, oscillations in the inner region of the resonant panel can be rapidly damped by the provision of a separate damping member in contact with the inner region of the resonant panel. Rapid damping of the oscillations in the inner region of the resonant panel ensures that the oscillations do not unacceptably damp the oscillations in the outer region of the resonant panel and therefore also ensure that the frequency response of the flat panel loudspeaker is not undesirably damped in parts of the frequency response.

A stiffness of the resonant panel in the inner region may be greater than a stiffness of the resonant panel in a region of the resonant panel outside the inner region. Oscillations in the inner region of the resonant panel can be rapidly damped by the stiffness of the inner region of the resonant panel being greater than the stiffness of the region of the resonant panel outside the inner region.

The damping member may be only coupled to the foot. Thus, the damping member is only in contact with the resonant panel and is not coupled directly to it. In some embodiments, the damping member may be integrally formed with the foot. The damping member may be rigidly coupled to the foot. Thus, the damping member is braced against the foot.

The damping member may be coupled to the resonant panel. Thus, the damping member may directly brace against motion in the resonant panel through the connection between the damping member and the resonant panel by absorption and dissipation of energy through internal forces in the damping member.

The inner region of the resonant panel may be formed from a material different from a material of the region of the resonant panel outside the inner region. Thus, the resonant panel may be formed from different materials in different regions. The stiffness of the inner region of the resonant panel may be altered through the choice of materials for the inner region and the region outside the inner region.

The inner region of the resonant panel may be formed to have a structure different from a structure of the region of the resonant panel outside the inner region. Thus, in some embodiments, even where the material of the resonant panel is the same in the inner region and the region outside the inner region, the material structure may be different, such that the stiffness of the inner region is greater than the stiffness of the region outside the inner region.

The inner region of the resonant panel may comprise a stiffening structure provided within the resonant panel. Thus, in some embodiments, a separate component in the form of a stiffening structure may be provided within the resonant panel to stiffen the resonant panel within the inner region. The inner region of the resonant panel may comprise a stiffening layer provided on the resonant panel.

The damping member may comprise a plurality of fins extending in a plane substantially perpendicular to a plane of the resonant panel. Thus, the fins provide a damping member which may be lightweight and can damp oscillations of the resonant panel in the direction of the plane of the fins.

The fins may be shaped to span the foot at the point of contact with the resonant panel. Thus, the fins may extend from one side of a base of the foot to the other side of the base of the foot.

The fins may have a generally tapered shape away from the resonant panel. Thus, the fins are narrower near the foot and wider near the centre of the inner region. This shape gives effective dissipation of resonant energy.

The inner region of the resonant panel may be formed from the same material as the region of the resonant panel outside the inner region. Thus, where a damping member is provided (or another damping mechanism), the resonant panel may be formed from the same material across the whole of the resonant panel. In some embodiments, the resonant panel may be formed from the same group of materials across the whole of the resonant panel.

The foot may have a plurality of notches extending from the resonant panel towards the exciter. Thus, the increased stiffness of the foot due to the damping member being coupled to the foot (which otherwise dampens the response of the panel across the acoustic spectrum) may be at least partly counteracted by reducing the stiffness of the foot by introducing notches into the structure of the foot. This may reduce the effect of the damping member itself on the oscillations induced by the exciter in the region outside the inner region of the resonant member.

The resonant panel may have a front surface opposite the exciter. The front surface of the resonant panel may be substantially flat across the inner region. Thus, it may not be apparent to an end user that the damping member is present. Further, the flat panel loudspeaker may be incorporated seamlessly into a wall and may even be plastered, painted, or wallpapered over.

A mass of the damping member may be less than 50 grams. Thus, the damping member is not so heavy as to significantly affect the oscillatory response of the resonant panel in the region outside the inner region.

In accordance with a further aspect of the present invention, there is provided a damping member configured for use as the damping member in the flat panel loudspeaker as claimed in any preceding claim. Thus, the invention extends to the provision of the appropriately designed and configured damping member itself.

BRIEF DESCRIPTION OF THE DRAWINGS

Embodiments of the invention are further described hereinafter with reference to the accompanying drawings, in which.

DETAILED DESCRIPTION

Figure 2:
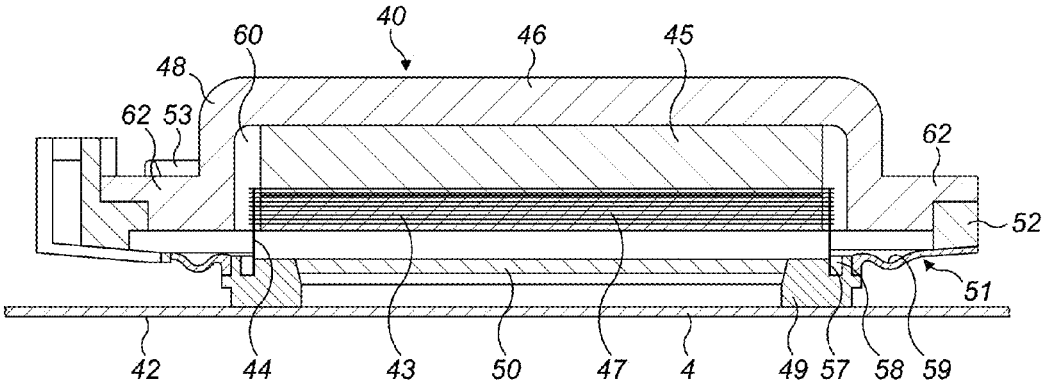
FIG. 2 is an illustration of an exciter for use in the distributed mode vibrating panel loudspeaker shown in FIG. 1 as discussed above.
Figure 3:
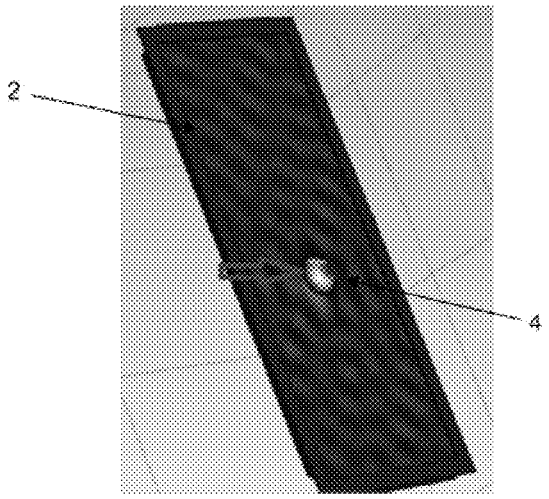
FIG. 3 is an illustration of a Finite Element Analysis model of a flat panel loudspeaker of the prior art showing the exaggerated surface displacement in the inner region inside the foot as discussed above.
Figure 5:
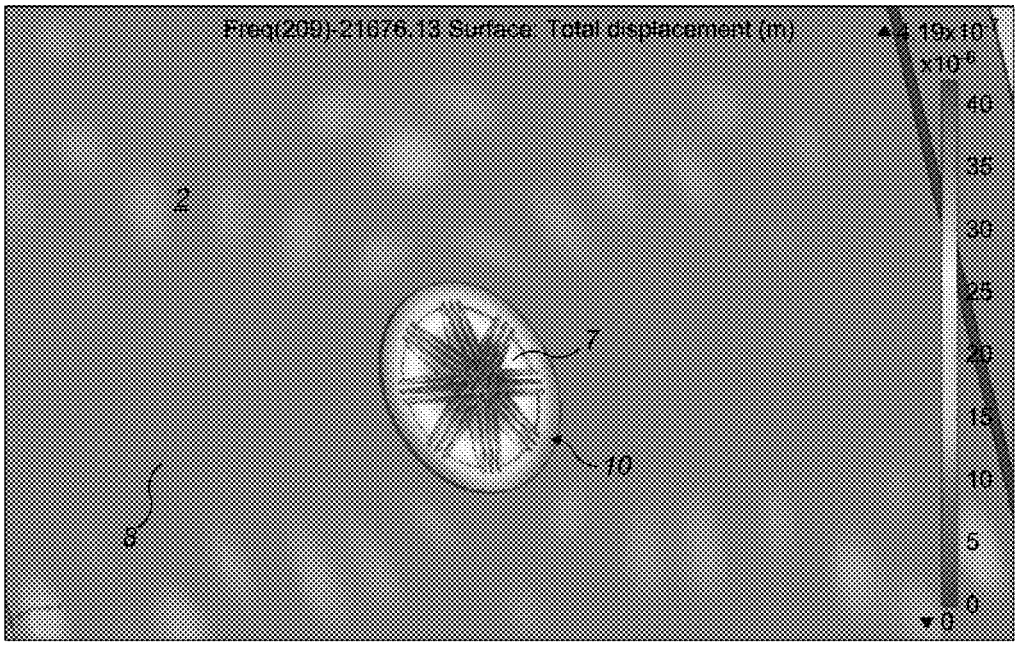
FIG. 5 is an illustration of one embodiment of a damping member that may be used with a flat panel loudspeaker.
Figure 6:
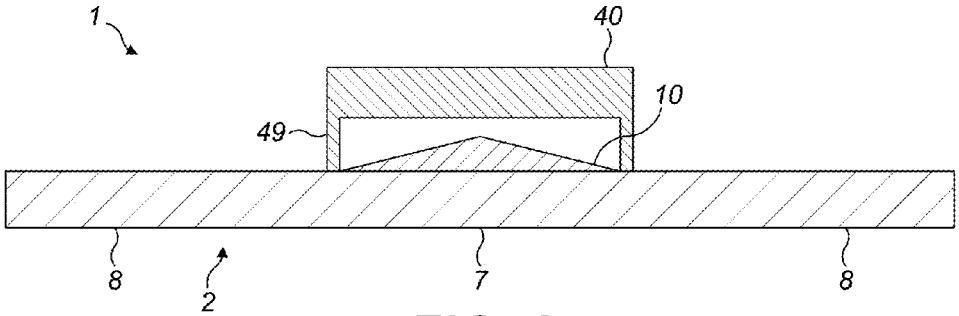
FIG. 6 is an illustration of a diagram of a cross section through a flat panel loudspeaker using the damping member shown in FIG. 5.

FIG. 5 is an illustration of a Finite Element Analysis model of one embodiment of a damping member that may be used with a flat panel loudspeaker. FIG. 6 is an illustration of a diagram of a cross section through a flat panel loudspeaker using the damping member shown in FIG. 5. The resonant panel 2 has defined an inner region 7 and an outer region 8. The outer region 8 bounds the inner region 7. The inner region 7 is typically a circular region and substantially corresponds to the central region 4 in FIG. 2. The foot 49 of the exciter 40 has defined therein a series of notches (not shown) which extend from the resonant panel 2 towards the rest of the exciter 40. A damping member 10 is provided on the resonant panel 2. The damping member is an integrally formed part and comprises a plurality of fin sets which extend in a plane perpendicular to a plane of the resonant panel 2 and span the inner region 7. Each fin set intersects the other fin sets at the centre of the inner region 7. Each fin set comprises a plurality of individual fins running parallel across the inner region 7. The fins have a generally tapered shape away from the resonant panel. A first edge of each fin is in contact with the resonant panel 2. A second edge of each fin tapers such that the fin is provided with a thin wedge at a peripheral of the inner region and a widest point at the centre of the inner region 7. The damping member 10 is positioned on the opposite side of the resonant panel 2 as the exciter 40. The damping member 10 braces the inner region 7 of the resonant panel 2 to improve the frequency response of the distributed mode vibrating panel loudspeaker 1. The damping member 10 is typically formed from a stiff, lightweight material such as plastics.

Figure 4:
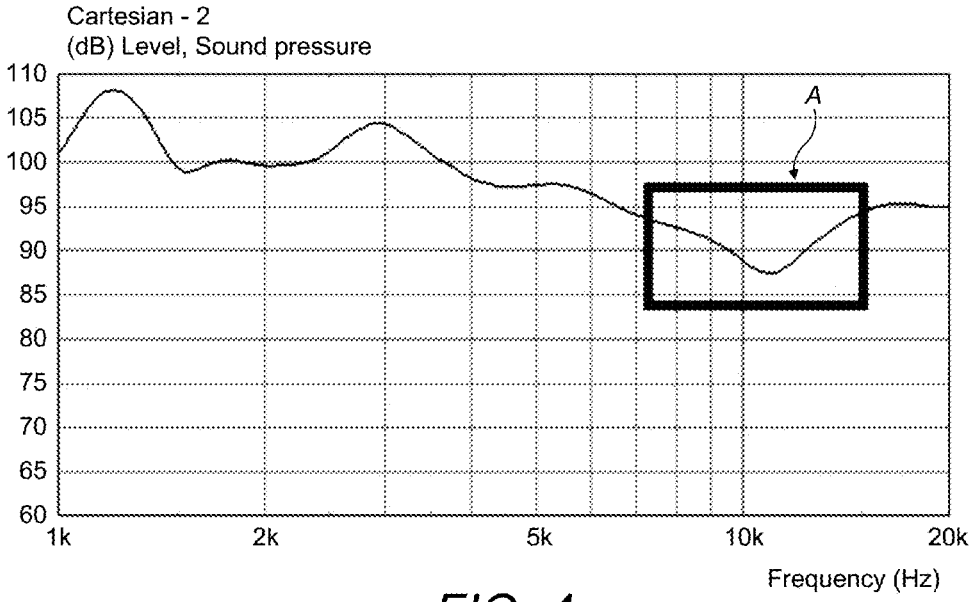
FIG. 4 is an illustration of a graph showing the frequency response of the flat panel loudspeaker shown in FIG. 1 as discussed above.
Figure 7:
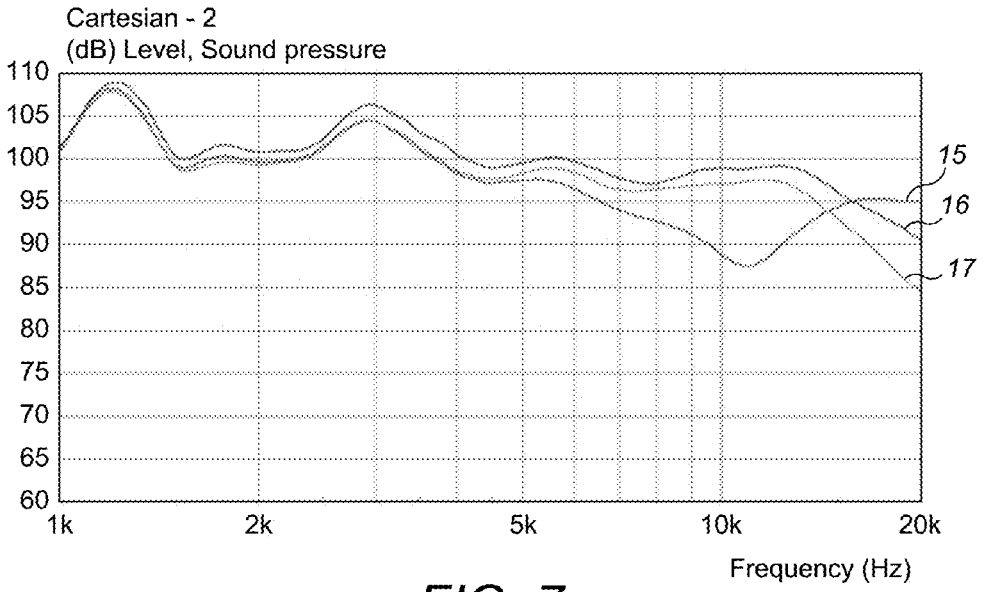
FIG. 7 is an illustration of a graph showing the theoretical frequency response for a number of different flat panel loudspeakers.

FIG. 7 is an illustration of a graph showing the theoretical frequency response for a number of different flat panel loudspeakers. A finite element analysis model was created of several different flat panel loudspeaker designs. The graph shows the frequency response of each of the different finite element analysis models. A prior art response line 15 is the same as that discussed in relation to FIG. 4 above. A removed inner region line 16 corresponds to the frequency response of a finite element model created of the configuration where the inner region of the resonant panel has been removed. It can be seen that removing the inner region of the resonant panel within the foot removes a dip in the frequency response around the 11 kHz area. However, it can also be seen that the frequencies above approximately 15 kHz appear to exhibit a reduced response. A damping member response line 17 in the graph corresponds to the frequency response of a finite element model created of the configuration where the resonant panel has a damping member connected over the inner region to dampen oscillations in the central region of the resonant panel. As can be seen from the graph, providing a damping member to the material in the central region of the resonant panel has almost the same magnitude of effect as removing the material entirely. In a similar way to the removed inner region line 16, it can be seen that the frequency response of the damping member response line 17 above approximately 15 kHz appears more damped compared to the unaltered resonant panel shown by the prior art response line 15.

Figure 1:
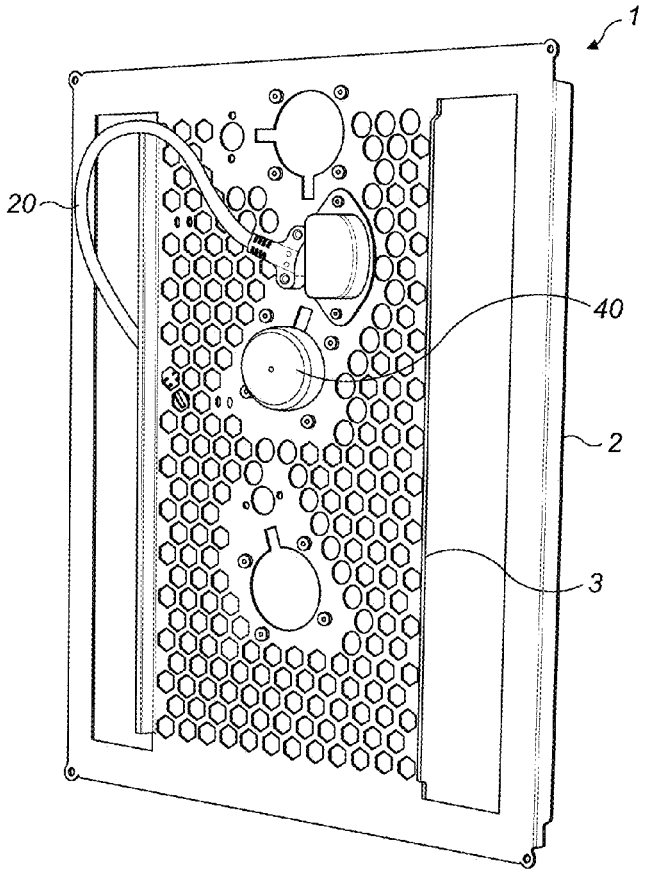
FIG. 1 is an illustration of a distributed mode vibrating panel loudspeaker of the prior art as discussed above.
Figure 8:
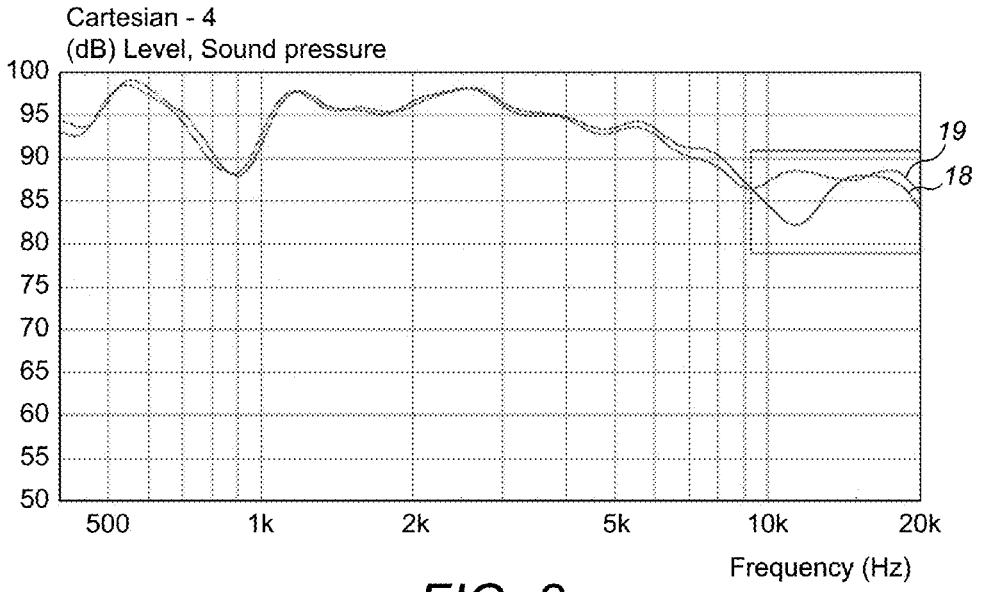
FIG. 8 is an illustration of a graph showing the measured frequency response of the flat panel loudspeaker in FIG. 1 with the flat panel loudspeaker using the damping member shown in FIG. 5.

FIG. 8 is an illustration of a graph showing the measured frequency response of the flat panel loudspeaker in FIG. 1 with the flat panel loudspeaker using the damping member shown in FIG. 5. Following the theoretical modelling, a stereolithography model part was produced of a damping member as shown in FIG. 5. A prior art measured frequency response line 18 is the measured frequency response of a flat panel loudspeaker without a damping member fitted. A damping member measured frequency response line 19 is the measured frequency response of a flat panel loudspeaker after fitting the damping member to the resonant panel. In a similar way to that predicted from the theoretical modelling shown by the graph in FIG. 7, the prior art measured frequency response line 18 features a notch in the frequency response around 11 kHz. However, in the damping member measured frequency response line 19, the notch is significantly reduced. The frequency response of the damped resonant panel correlates well with the frequency response of the undamped resonant panel across the rest of the frequency range.

Figure 9:
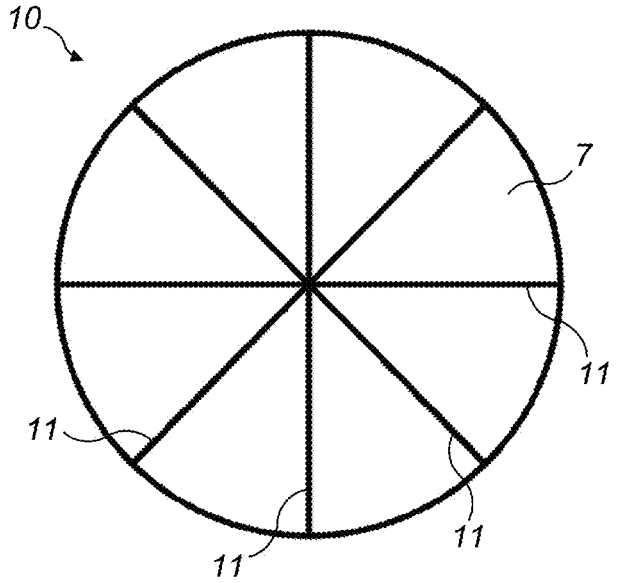
FIG. 9 and FIG. 10 are illustrations of a top-down view of different embodiments of the damping member shown in FIG. 5.
Figure 10:
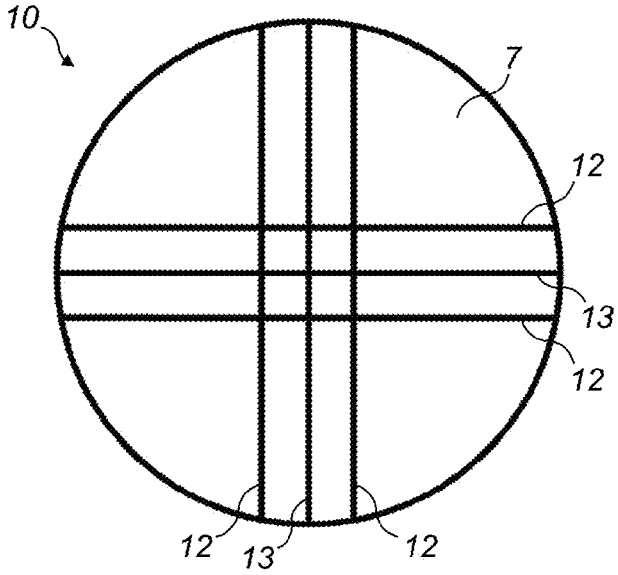

FIG. 9 and FIG. 10 are illustrations of a top-down view of different embodiments of the damping member shown in FIG. 5. Each damping member 10 is configured to contact an inner region 7 of the resonant panel, and is formed from a plurality of fins 11 substantially as described with reference to FIGS. 5 and 6 above, but with the hereinafter described differences. The damping member 10 shown in FIG. 9 features a wheel and spoke structure with fins 11 provided at 45 degree intervals, each passing through a central point of the damping member 10. The fins 11 are each of the same length such that tips of each fin 11 lie on a circle with diameter equal to the length of each fin 11. The damping member shown in FIG. 10 comprises a first fin set and a second fin set, perpendicular to the first fin set and intersecting the first fin set through a central point of the damping member 10. The first fin set and the second fin set each comprise three mutually spaced fins 12, 13. Each of a pair of outer fins 12 in each fin set are shorter than a central fin 13 in the fin set, such that tips of each fin 12, 13 lie on a circle with diameter equal to the length of each central fin 13.

Figure 11:
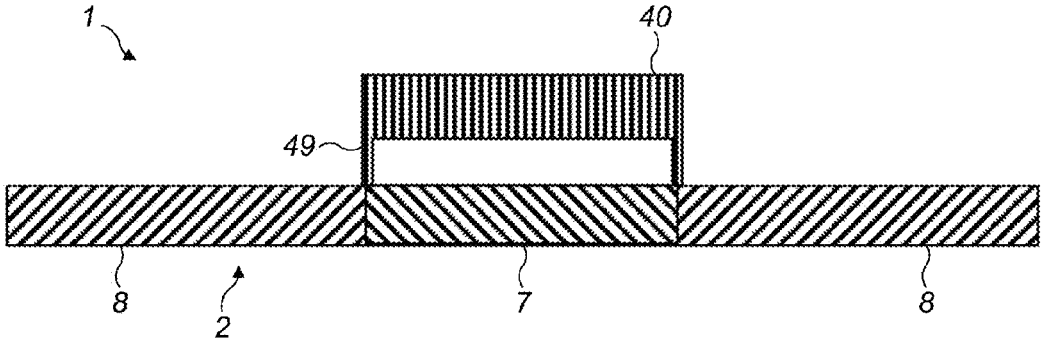
FIG. 11 is an illustration of a diagram of a cross section through one embodiment of a flat panel loudspeaker.

Although the flat panel loudspeaker has been described as having a damping member to mitigate oscillations in the inner region, it will be appreciated that the same effect can be achieved using alternative mechanisms. These may be provided in addition to the damping member. FIG. 11 is an illustration of a diagram of a cross section through an alternative embodiment of a flat panel loudspeaker. The flat panel loudspeaker 1 comprises a resonant panel 2 connected to an exciter 40 via a foot 49. An inner region 7 of the resonant panel 2 is defined within a footprint of the connection between the exciter 40 and the resonant panel 2. An outer region 8 is the region of the resonant panel outside the inner region 7. The material or structural properties of the resonant panel 2 is different between the inner region 7 and the outer region 8 such that the inner region 7 is braced against the motion of the resonant panel 2 due to excitation by the exciter 40 via the foot 49. In some embodiments, the inner region 7 of the resonant panel may be formed from a different material from the outer region 8 of the resonant panel. In alternative embodiments, the inner region 7 and the outer region 8 may be formed from the same material, but the material properties may be different through different manufacturing processes, and/or the internal structure of the inner region 7 and the outer region 8 may be different. It will be appreciated that combinations of different materials, different material properties and different internal structures may be used to provide the feature that the inner region 7 is braced against motion of the resonant panel 2 in the inner region 7 when the resonant panel 2 is excited by the exciter 40.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers and characteristics described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention is as defined in the accompanying claims.

I claim:

1. A flat panel loudspeaker comprising:

a resonant panel;

an exciter comprising a foot generally cylindrical in shape, coupled to the resonant panel, the foot defining an inner region of the resonant panel, wherein the exciter is drivable to vibrate the resonant panel via the foot, whereby to produce a sound; and a damping member coupled to the foot and in contact with the inner region of the resonant panel, the damping member arranged inside the foot to generally brace against the vibration of the resonant panel so as to damp a response of the resonant panel in the inner region to a vibration from the exciter.

2. A flat panel loudspeaker as claimed in claim 1, wherein the damping member is only coupled to the foot.

3. A flat panel loudspeaker as claimed in claim 1, wherein the damping member is rigidly coupled to the foot.

4. A flat panel loudspeaker as claimed in claim 1, wherein the damping member is coupled to the resonant panel.

5. A flat panel loudspeaker as claimed in claim 1, wherein a stiffness of the resonant panel in the inner region is greater than a stiffness of the resonant panel in a region of the resonant panel outside the inner region.

6. A flat panel loudspeaker as claimed in claim 1, wherein the inner region of the resonant panel is formed from a material different from a material of the region of the resonant panel outside the inner region.

7. A flat panel loudspeaker as claimed in claim 1, wherein the inner region of the resonant panel is formed to have a molecular structure different from a molecular structure of the region of the resonant panel outside the inner region.

8. A flat panel loudspeaker as claimed in claim 1, wherein the inner region of the resonant panel comprises a stiffening structure provided within the resonant panel.

9. A flat panel loudspeaker as claimed in claim 1, wherein the damping member comprises a plurality of fins extending in a plane substantially perpendicular to a plane of the resonant panel.

10. A flat panel loudspeaker as claimed in claim 9, wherein the fins are shaped to span the foot at the point of contact with the resonant panel.

11. A flat panel loudspeaker as claimed in claim 9, wherein the fins have a generally tapered shape away from the resonant panel.

12. A flat panel loudspeaker as claimed in claim 1, wherein the inner region of the resonant panel is formed from the same material as the region of the resonant panel outside the inner region.

13. A flat panel loudspeaker as claimed in claim 1, wherein the foot has a plurality of notches extending from the resonant panel towards the exciter.

14. A flat panel loudspeaker as claimed in claim 1, wherein the resonant panel has a front surface opposite the exciter, and wherein the front surface of the resonant panel is substantially flat across the inner region.

15. A flat panel loudspeaker as claimed in claim 1, wherein a mass of the damping member is less than 50 grams.

16. A damping member configured for use as the damping member in the flat panel loudspeaker as claimed in claim 1.

17. A flat panel loudspeaker comprising:

a resonant panel;

an exciter comprising a foot generally cylindrical in shape, coupled to the resonant panel and defining an inner region of the resonant panel, wherein the exciter is drivable to vibrate the resonant panel via the foot, whereby to produce a sound; and a damping member coupled to the foot and in contact with the inner region of the resonant panel and arranged inside the foot to generally brace against the vibration of the resonant panel so as to damp a response of the resonant panel in the inner region to a vibration from the exciter;

wherein the damping member comprises a plurality of fins extending in a plane substantially perpendicular to a plane of the resonant panel.

18. The flat plan loudspeaker as claimed in claim 17, wherein the fins are shaped to span the foot at the point of contact with the resonant panel.

19. The flat plan loudspeaker as claimed in claim 17, wherein the fins have a generally tapered shape away from the resonant panel.

20. A flat panel loudspeaker as claimed in claim 17, wherein the damping member is only coupled to the foot.

* * * * *